US011081833B2

(12) United States Patent
Zhao et al.

(10) Patent No.: US 11,081,833 B2
(45) Date of Patent: Aug. 3, 2021

(54) ELECTRICAL CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Jie Su, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/830,256

(22) Filed: Mar. 25, 2020

(65) Prior Publication Data

US 2020/0313342 A1 Oct. 1, 2020

(30) Foreign Application Priority Data

Mar. 26, 2019 (CN) ..... 201920393862.3
Apr. 2, 2019 (CN) ..... 201920440143.2

(51) Int. Cl.
*H01R 43/24* (2006.01)
*H01R 13/52* (2006.01)

(52) U.S. Cl.
CPC ..... *H01R 13/521* (2013.01); *H01R 13/5216* (2013.01); *H01R 43/24* (2013.01)

(58) Field of Classification Search
CPC .. H01R 13/521; H01R 13/5216; H01R 43/24; H01R 12/724; H01R 13/50; H01R 13/6585; H01R 13/405; H01R 2107/00; H01R 2201/16; H01R 24/60
See application file for complete search history.

(56) References Cited

U.S. PATENT DOCUMENTS

2009/0258521 A1* 10/2009 Ooki ..... H01R 13/5216 439/275
2015/0255905 A1* 9/2015 Little ..... H01R 13/6658 439/78

(Continued)

FOREIGN PATENT DOCUMENTS

CN 207572620 U 7/2018
CN 208445029 U 1/2019

*Primary Examiner* — Truc T Nguyen
(74) *Attorney, Agent, or Firm* — Ming Chieh Chang; Wei Te Chung

(57) ABSTRACT

An electrical connector includes a contact module essentially composed of a plurality of contacts integrally formed within an insulator via an insert-molding process. The insulator includes a base, tongue extending forwardly from the base, and a mounting port extending rearwardly from the base. The contact includes a front contacting section exposed upon the tongue, a rear soldering tail exposed outside of the base and a middle retaining section therebetween. A groove is formed between the base and the mounting port to expose middle sections of the contacts. An insulative housing is over molded upon the contact module for not only forming an exterior structure of the connector but also filling the groove for enhancing sealing between the contacts and the insulator.

14 Claims, 20 Drawing Sheets

(56) References Cited

U.S. PATENT DOCUMENTS

| | | | | |
|---|---|---|---|---|
| 2016/0006163 | A1* | 1/2016 | Tashiro | H01R 13/5216<br>439/587 |
| 2016/0294105 | A1* | 10/2016 | Zhao | H01R 12/724 |
| 2017/0005521 | A1* | 1/2017 | Youn | H04B 1/3888 |
| 2017/0099742 | A1* | 4/2017 | Choi | H05K 5/03 |
| 2017/0294738 | A1* | 10/2017 | Zhao | H01R 13/6585 |
| 2017/0302031 | A1* | 10/2017 | Cheng | H01R 13/6581 |
| 2018/0206354 | A1* | 7/2018 | Yoon | G06F 1/1688 |
| 2019/0067872 | A1* | 2/2019 | Cha | H01R 13/516 |
| 2020/0136299 | A1* | 4/2020 | Zhao | H01R 13/405 |
| 2021/0044061 | A1* | 2/2021 | Zhou | H01R 13/6581 |

* cited by examiner

ELECTRICAL CONNECTOR

BACKGROUND OF THE INVENTION

1. Field of the Invention

The present invention relates generally to an electrical connector assembly, and particularly to the connector without the metallic shell but with an insulative shell with waterproofing structure thereof.

2. Description of Related Arts

The metallic shell of the receptacle connector built in the mobile phone may cause an interference with regard to the antenna. On the other hand, the waterproofing function between the contacts and the housing and that between the metallic shell and the housing are another concern.

Hence, an electrical connector with a good waterproofing function but without the metallic shell is desired.

SUMMARY OF THE INVENTION

To achieve the above object, an electrical connector includes a contact module essentially composed of a plurality of contacts integrally formed within an insulator via an insert-molding process. The insulator includes a base, tongue extending forwardly from the base, and a mounting port extending rearwardly from the base. The contact includes a front contacting section exposed upon the tongue, a rear soldering tail exposed outside of the base and a middle retaining section therebetween. A groove is formed between the base and the mounting port to expose middle sections of the contacts. An insulative housing is over molded upon the contact module for not only forming an exterior structure of the connector but also filling the groove for enhancing sealing between the contacts and the insulator. Specifically, the insulative housing is made via the liquid silicon rubber for also enhancing waterproofing between the connector and the enclosure of the mobile phone. Another feature of the invention is to provide an escaping groove in the mounting port around the soldering tails for not contaminating the soldering tails.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
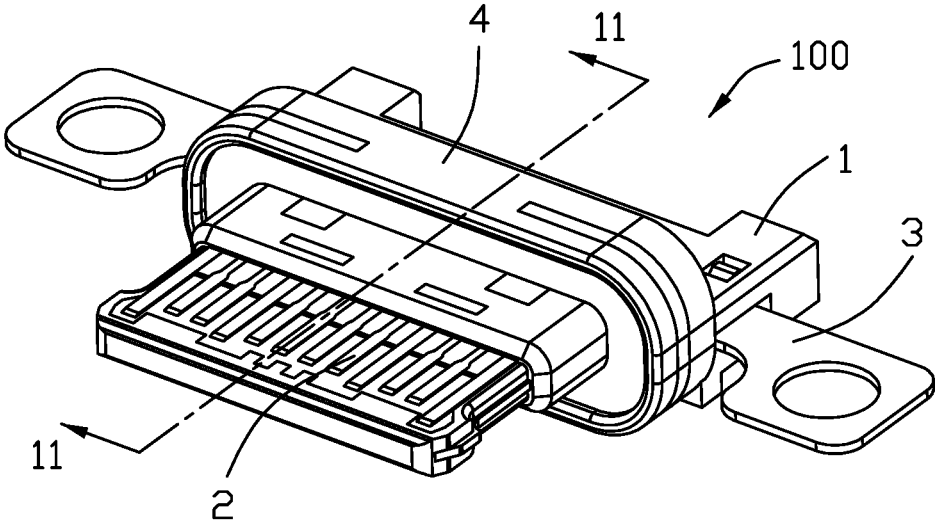
FIG. 1 is a perspective view of the electrical connector of a first preferred embodiment of the present invention.
Figure 2:
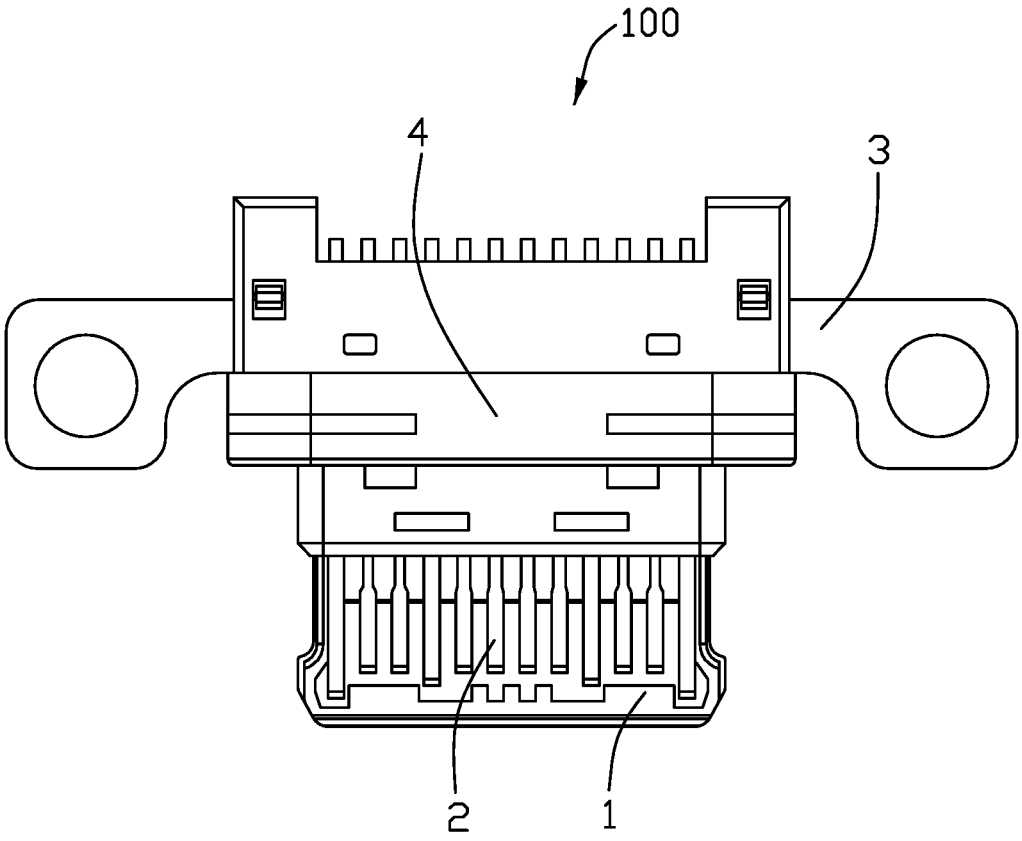
FIG. 2 is a top view of the electrical connector of FIG. 1.
Figure 3:
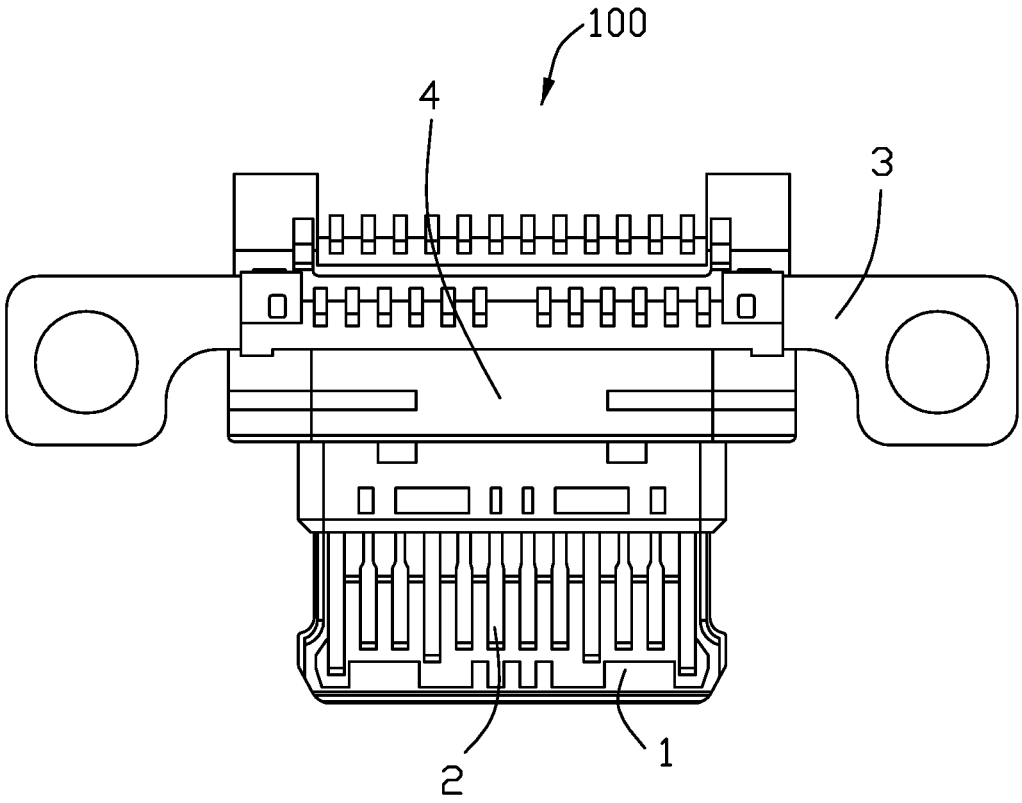
FIG. 3 is a bottom view of the electrical connector of FIG. 1.
Figure 4:
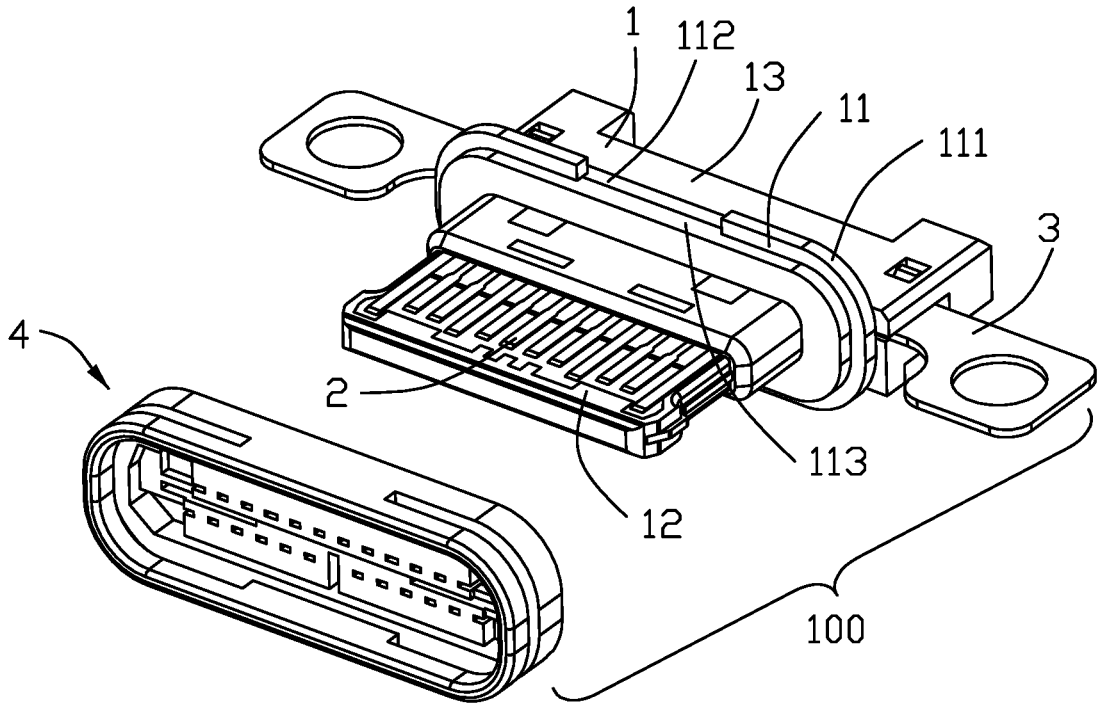
FIG. 4 is an exploded perspective view of the electrical connector of FIG. 1.
Figure 5:
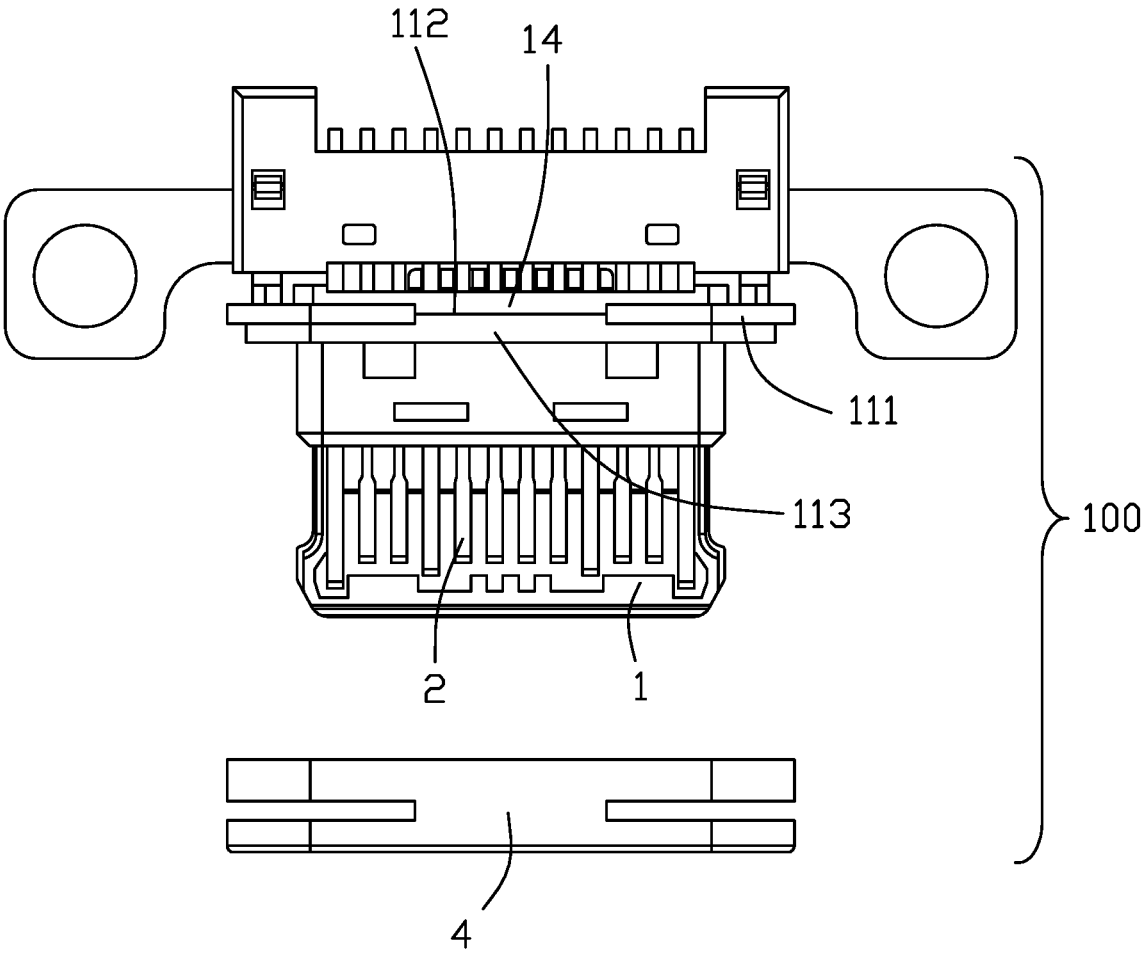
FIG. 5 is a top exploded view of electrical connector of FIG. 4.
Figure 6:
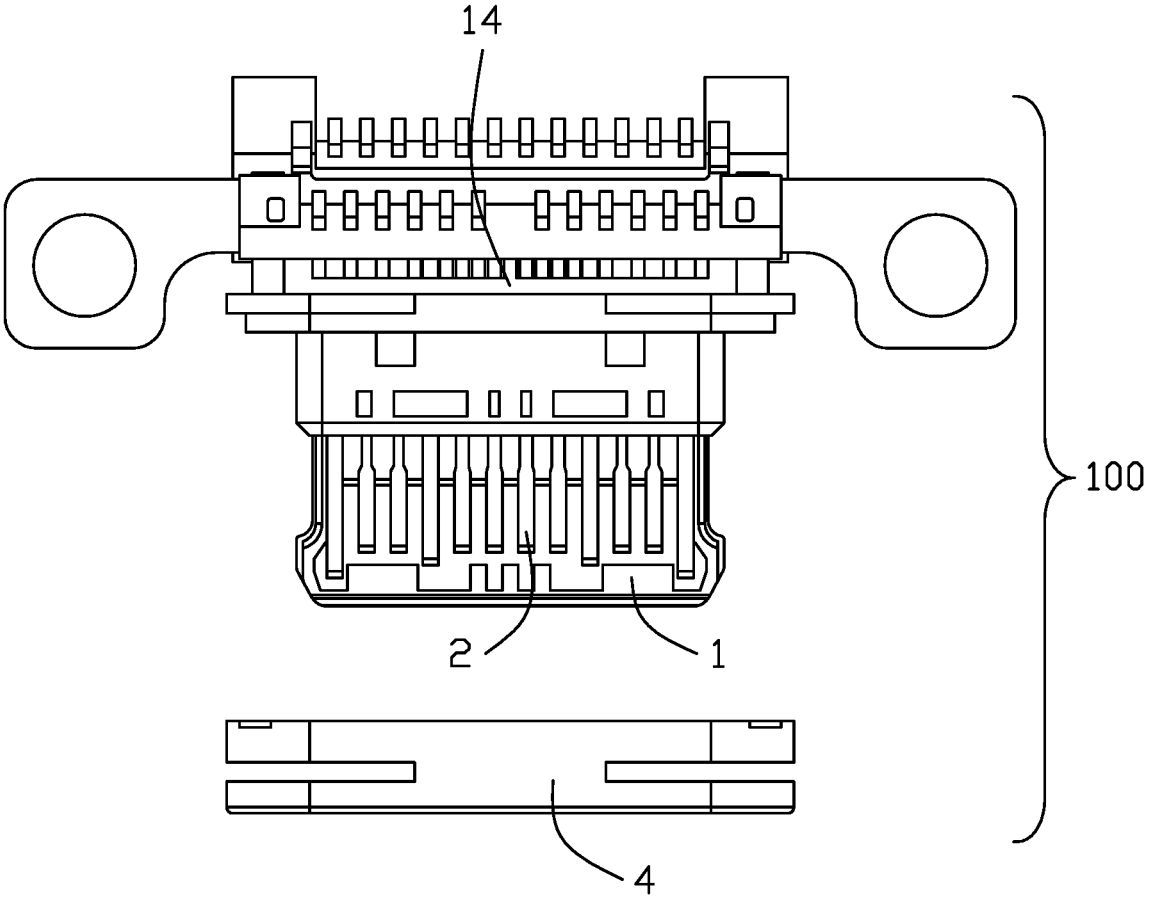
FIG. 6 is a bottom exploded view of the electrical connector of FIG. 5.
Figure 7:
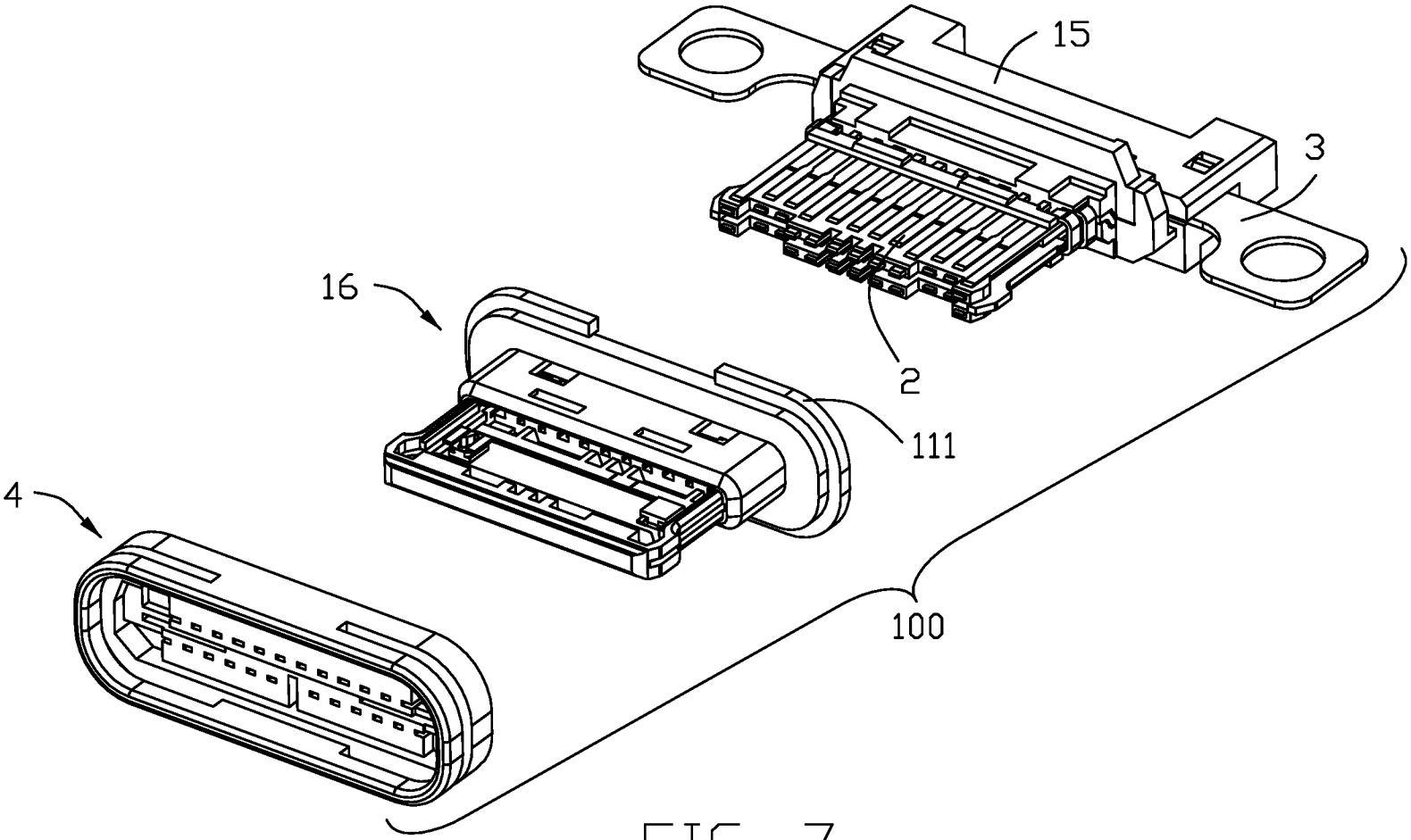
FIG. 7 is a further exploded perspective view of the electrical connector of FIG. 4.
Figure 8:
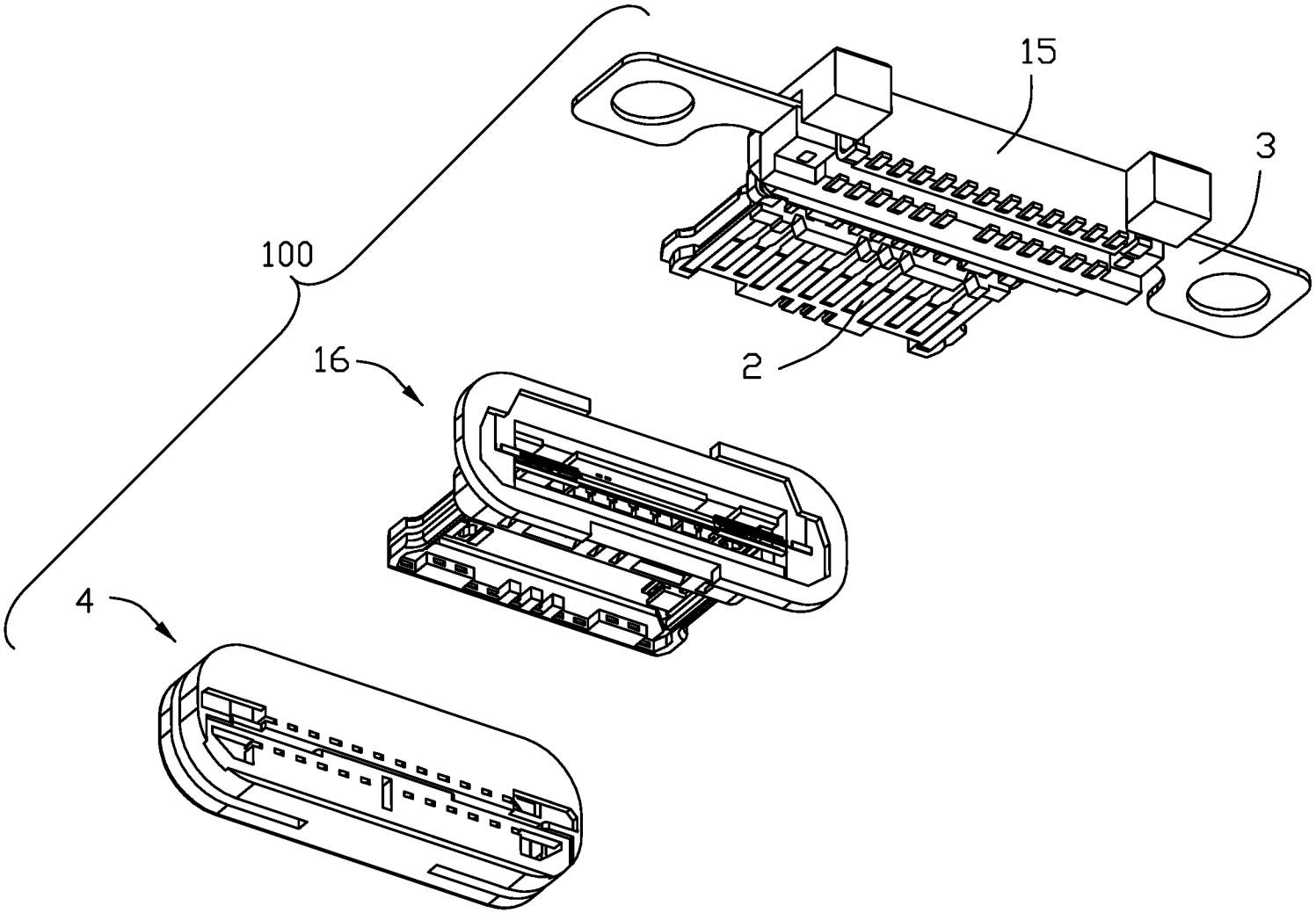
FIG. 8 is another exploded perspective view of the electrical connector of FIG. 7.
Figure 9:
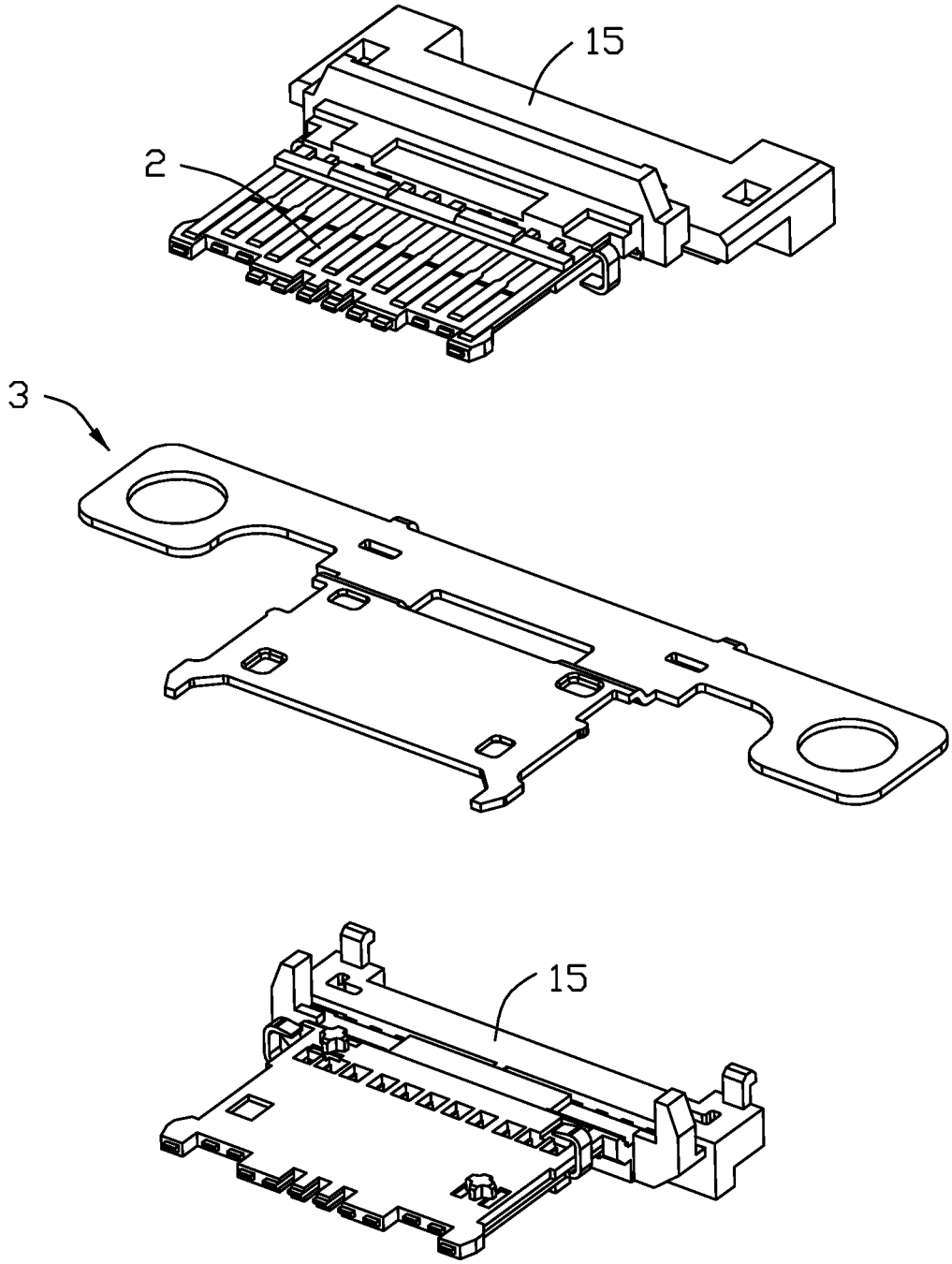
FIG. 9 is an exploded perspective view of the contact module of the electrical connector of FIG. 7.
Figure 10:
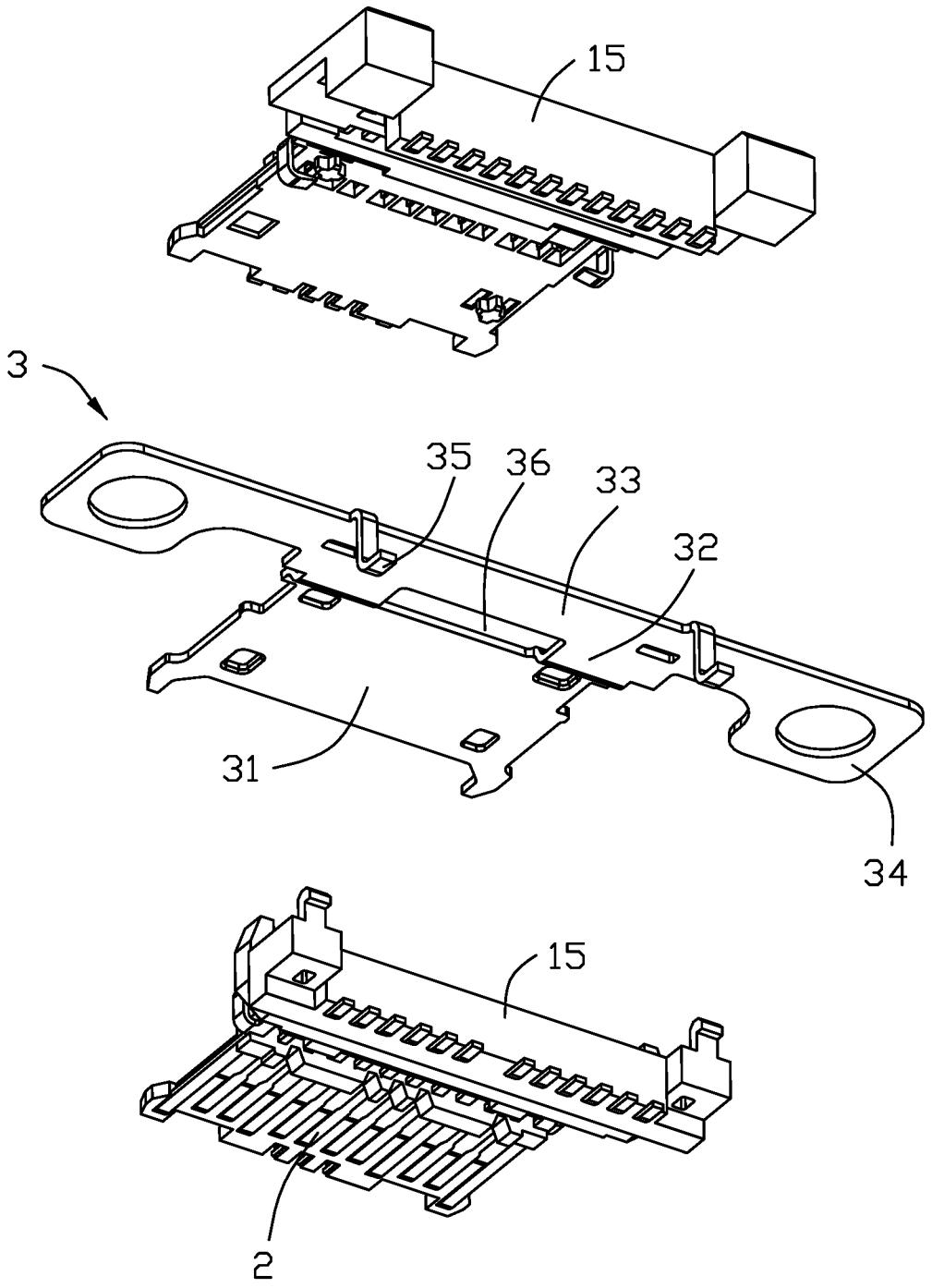
FIG. 10 is another exploded perspective view of the electrical connector of FIG. 9.
Figure 11:
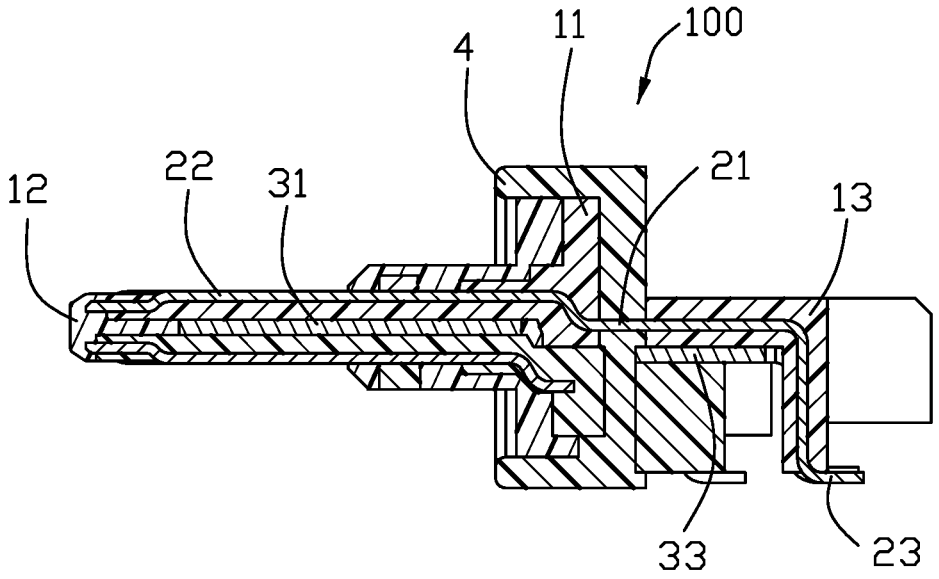
FIG. 11 is a cross-sectional view of the electrical connector of FIG. 1.

Referring to FIGS. 1-11, an electrical connector 100 is used for installation within a cellular phone (not shown). The connector 100 includes a contact module (not labeled) and an insulative housing 4 over-molded to the contact module. The contact module includes an insulator 1, a plurality of contacts 2 and a metallic shielding plate 3 integrally formed within the insulator 1 via insert-molding wherein the contacts 2 are arranged two rows and the metallic shielding plate 3 is located therebetween.

The insulator 1 includes a base 11 and a tongue 12 extending forwardly from the base 11, and a mounting port 13 extending rearwardly from the base 11. A groove 14 is formed between the base 11 and the mounting port 13 in the front-to-back direction. The base 11 includes a pair of semi-circular sections 111 with a cutout 112 therebetween. A circumferential groove 113 is located in front of the semi-circular sections 111 and communicates with the groove 14 via said cutout 112. The contact 2 includes the retaining section 21 retained to the base 11, a contacting section 21 extending forwardly from the retaining section 21 and exposed upon the tongue 12, and a soldering leg 23 extending rearward from the retaining section 21 and exposed upon the mounting port 13. The shielding plate 3 includes a front section 31, a pair of connecting sections 32, a rear section 33, a pair of securing sections 34 exposed outside on two lateral sides with corresponding through holes therein, and a pair of securing legs 35. A receiving opening 36 is formed between the pair of connecting sections 32.

The insulator 1 is essentially composed of a pair of first insulators 15 integrally formed with the two rows of contacts 2 respective via insert-molding, and the pair of first insulators 15 commonly sandwich the shielding plate 3 therebetween and further molded within a second insulator 16. The first insulator 15 and the second insulator 16 commonly form the whole insulator 1. The front section 31 of the shielding plate 3 is sandwiched in the tongue 12, the connecting section 32 is retained in the base 11, and the rear section 33 is sandwiched in the mounting port 13. A portion of the retaining sections 21 of the contacts 2 are exposed in the groove 14. The receiving opening 36 is aligned with the groove 14.

The insulative housing 4 is originally in a liquid type or melted manner, so as to fill the groove 14 to grasp the aforementioned exposed portions of the retaining sections 21 of the contacts in the groove 14 and fill the receiving opening 36. Clearly, the insulative housing 4 is further applied upon an exterior of the insulator 1 to fill the circumferential groove 113 so as to form the exterior configuration of the whole connector 100 for being snugly received within an opening of the mobile phone for mating with a cable connector for charging or signal transmission. Specifically, the insulative housing 4 is made of liquid silicon rubber for not only waterproofing but also deformation. Understandably, the insulative housing 4 not only efficiently seals the gap between the connector 100 and the enclosure of the mobile phone occurs outside of the connector 100 externally but also seals the gaps between the contacts and the insulator 1 internally. Notably, the semi-circular sections 111 are sandwiched in the insulative housing 4 in the front-to-back direction.

Figure 12:
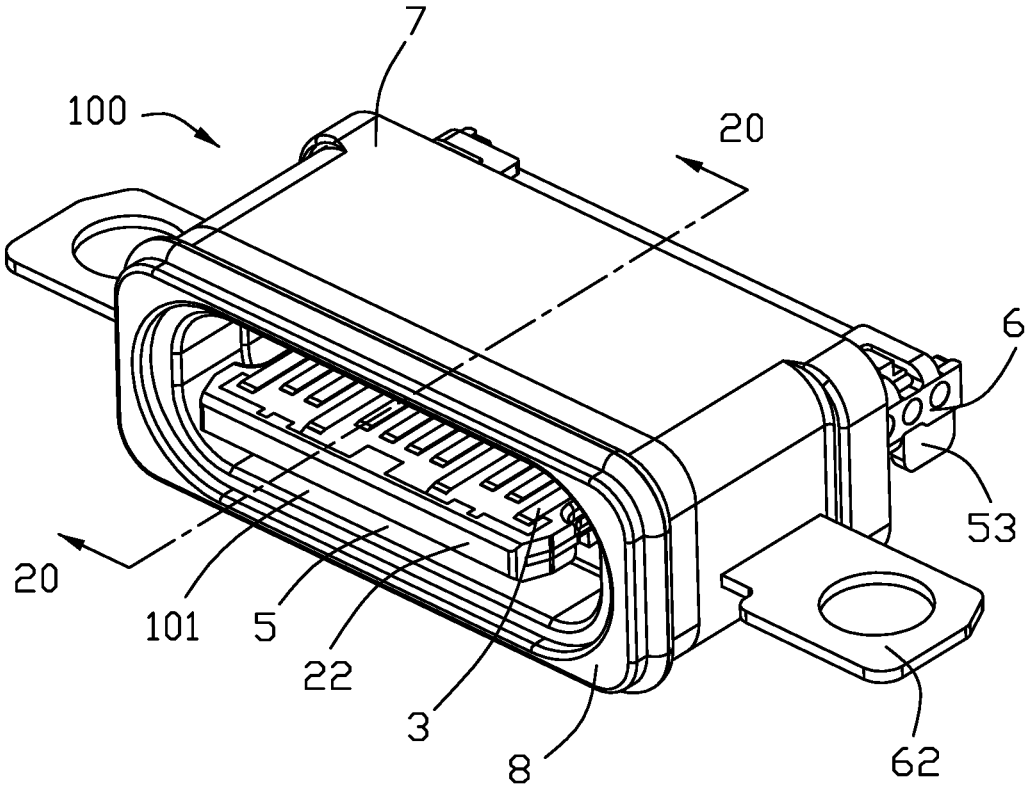
FIG. 12 is a perspective view of the electrical connector according to another embodiment of the invention.
Figure 13:
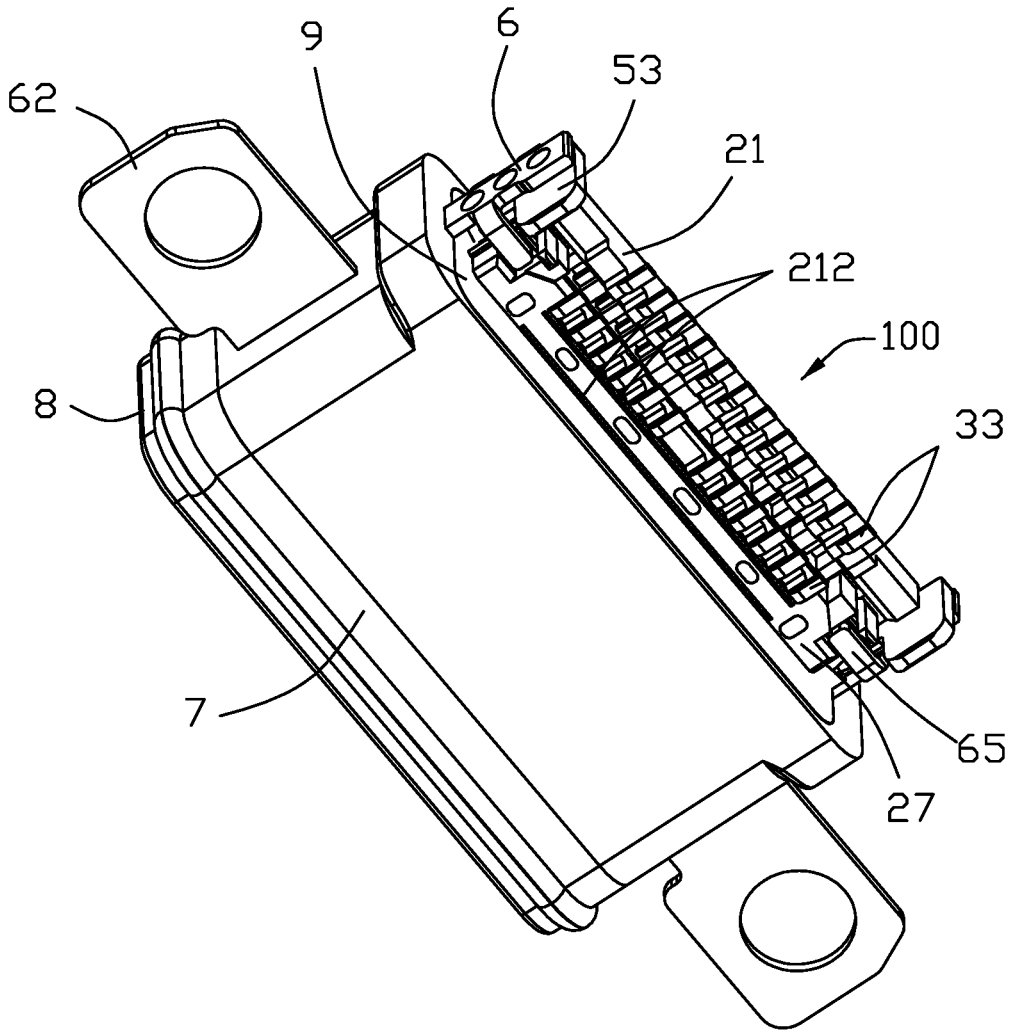
FIG. 13 is another perspective view of the electrical connector assembly of FIG. 12.
Figure 14:
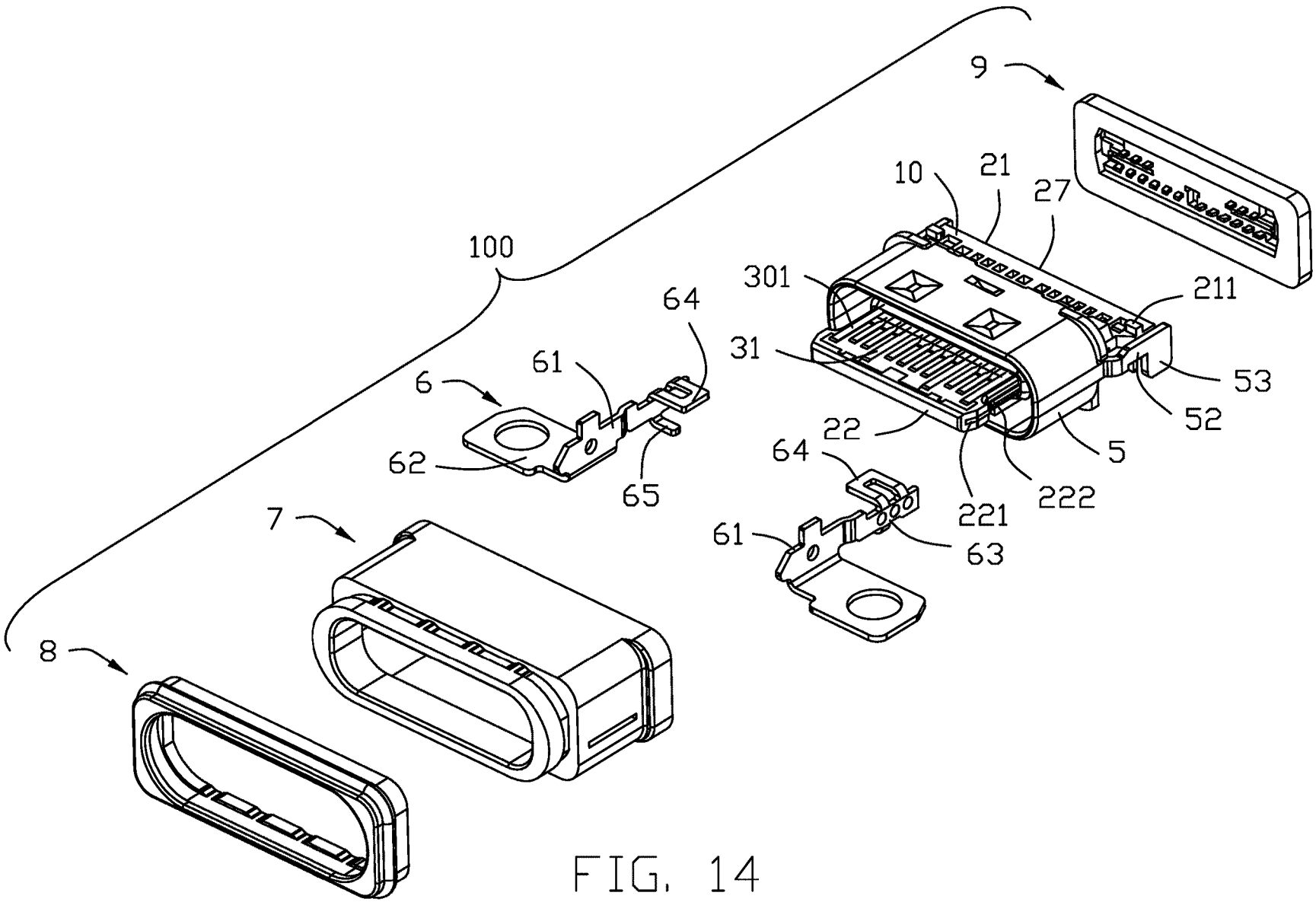
FIG. 14 is an exploded perspective view of the electrical connector of FIG. 13.
Figure 15:
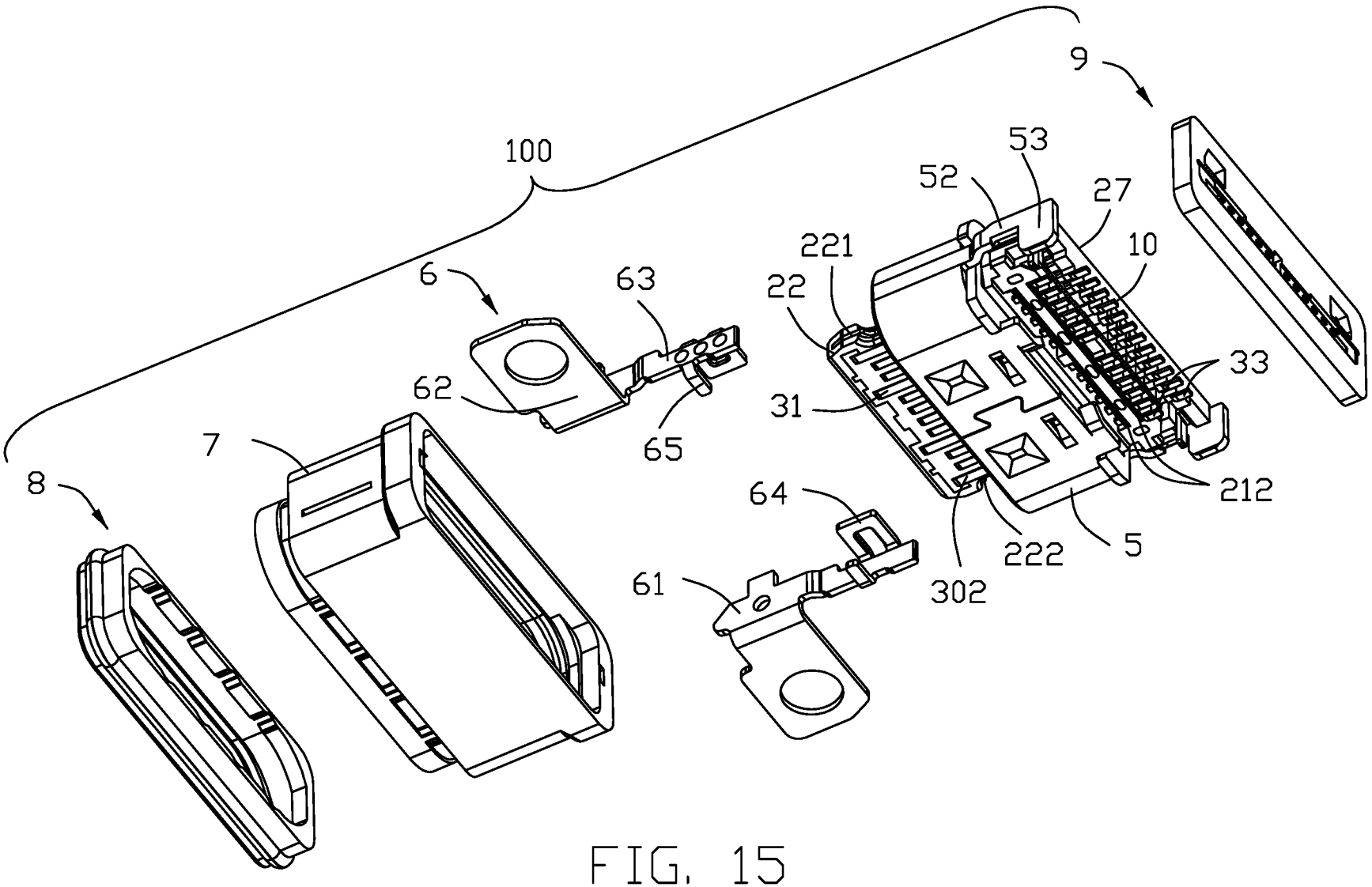
FIG. 15 is another exploded perspective view of the electrical connector of FIG. 14.
Figure 16:
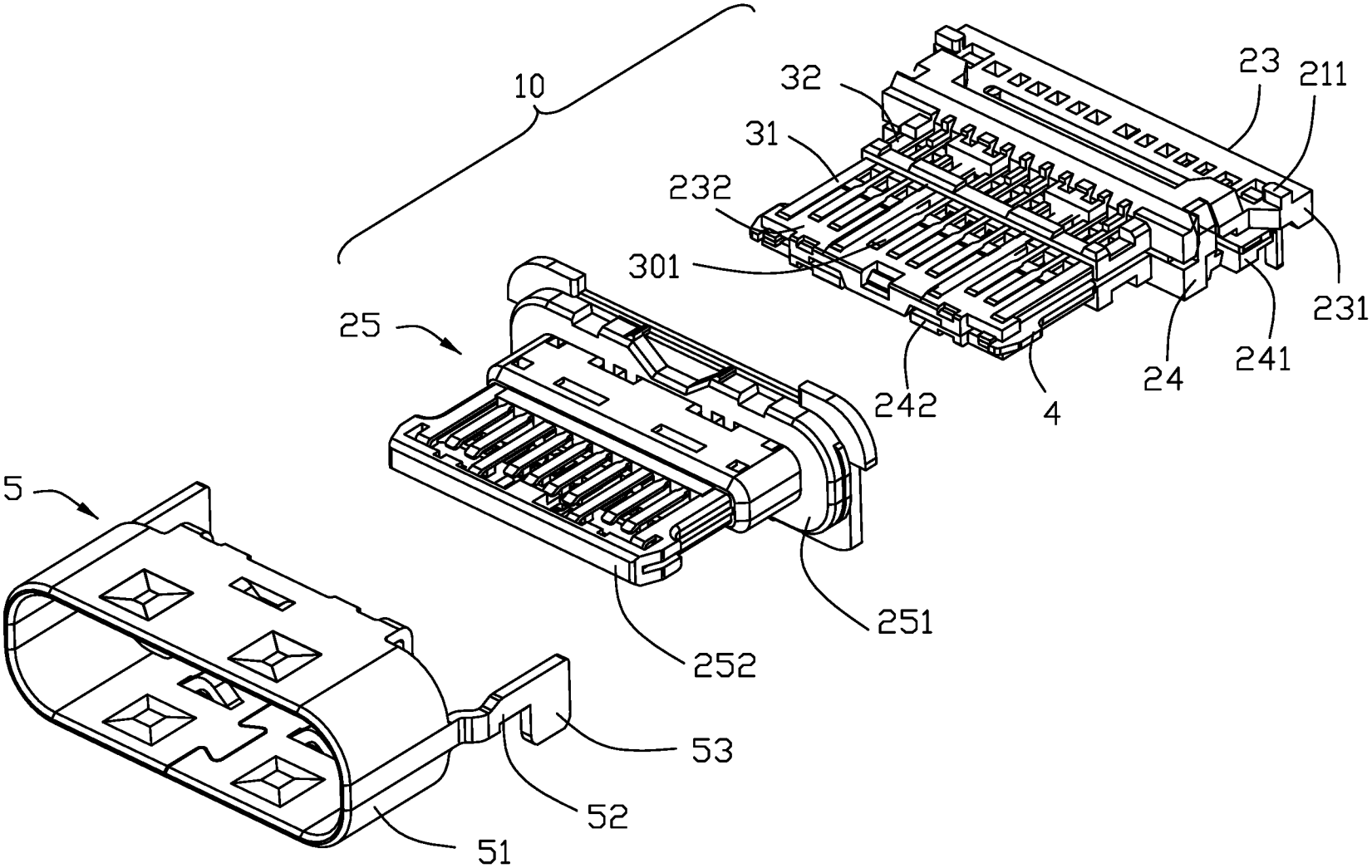
FIG. 16 is an exploded perspective view of the inner unit of the electrical connector of FIG. 12.
Figure 17:
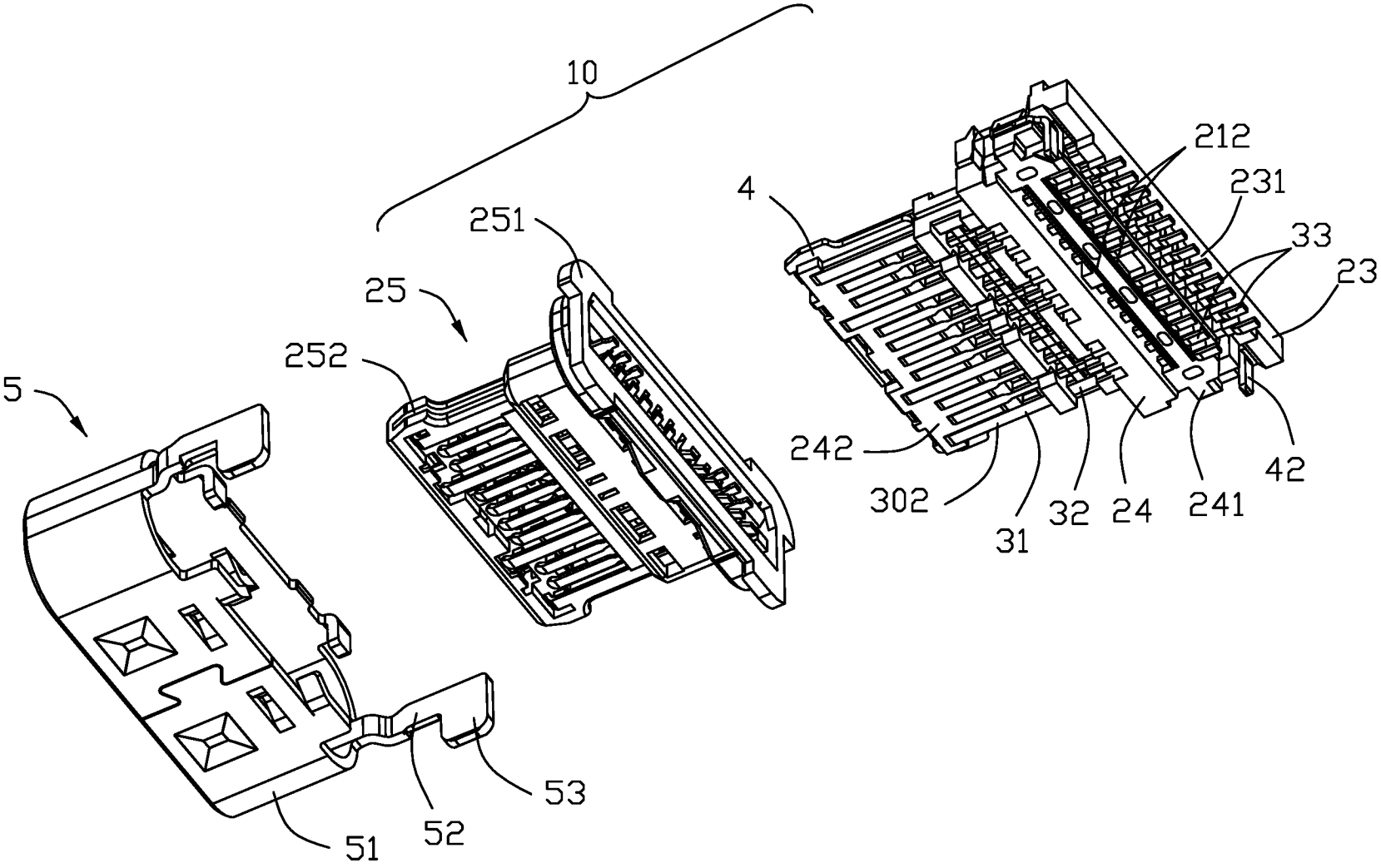
FIG. 17 is another exploded perspective view of the inner unit of the electrical connector of FIG. 16.
Figure 18:
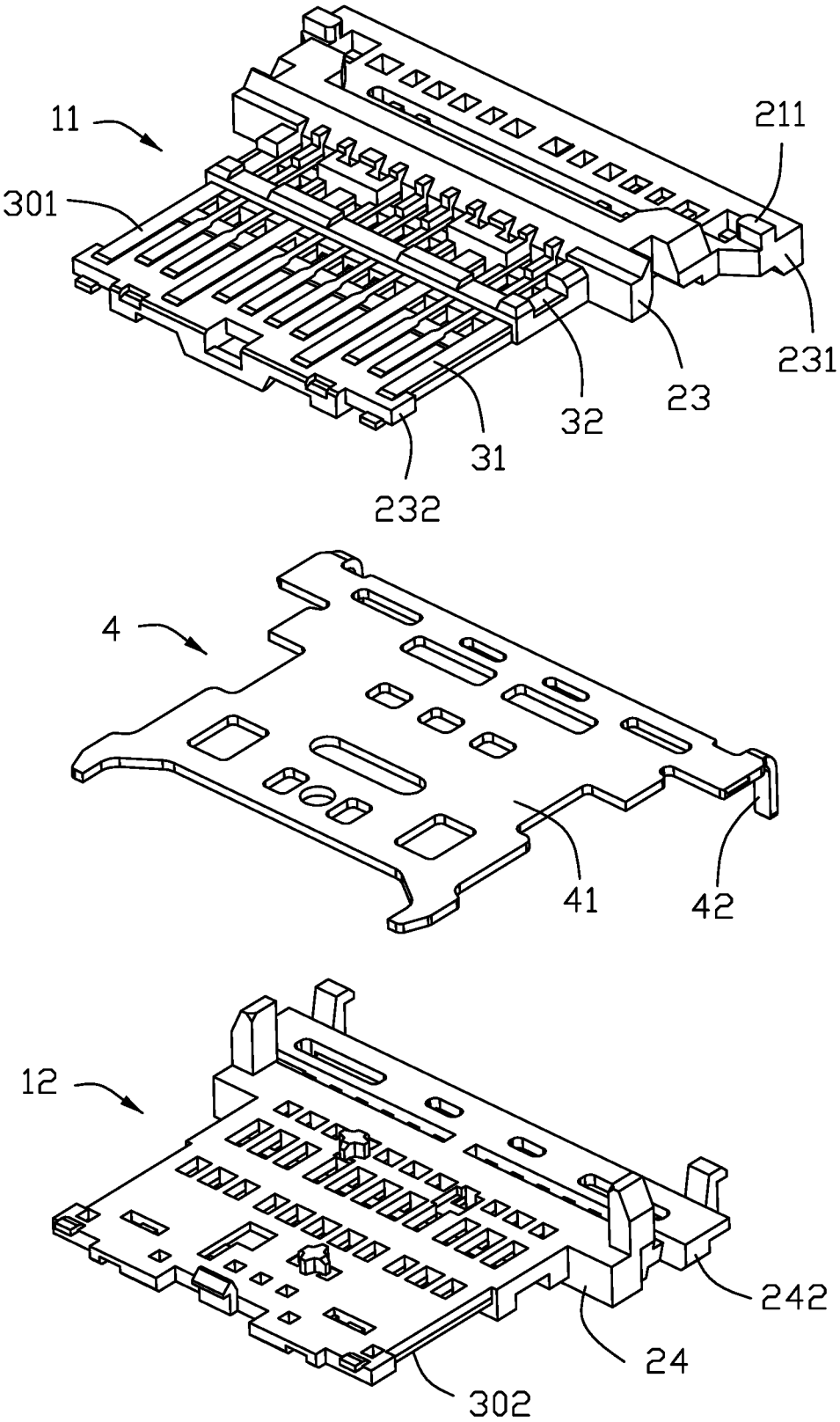
FIG. 18 is an exploded perspective view of the contact module of the inner unit of the electrical connector of FIG. 16.
Figure 19:
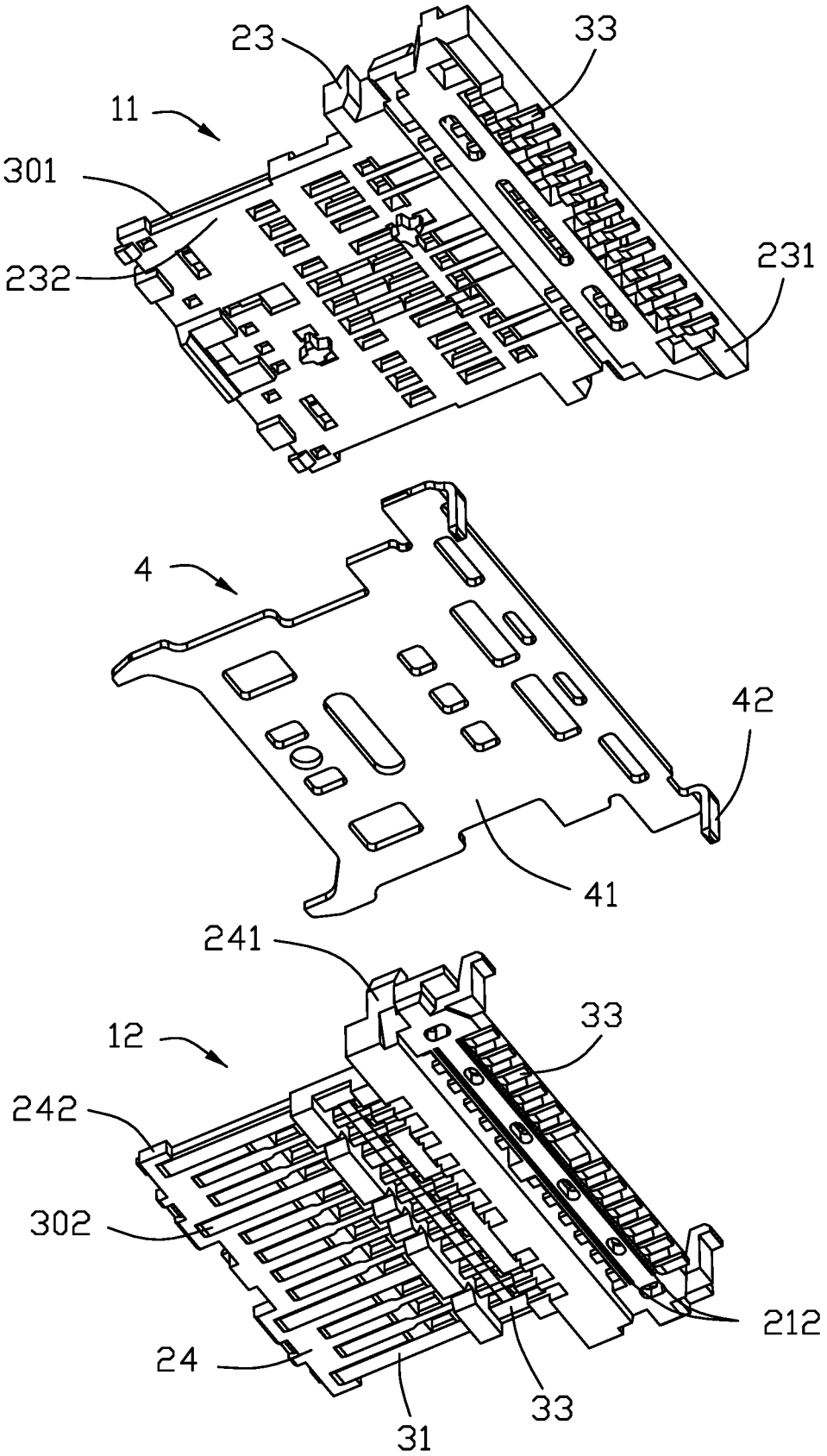
FIG. 19 is another exploded perspective view of the contact module of the inner unit of the electrical connector of FIG. 18.
Figure 20:
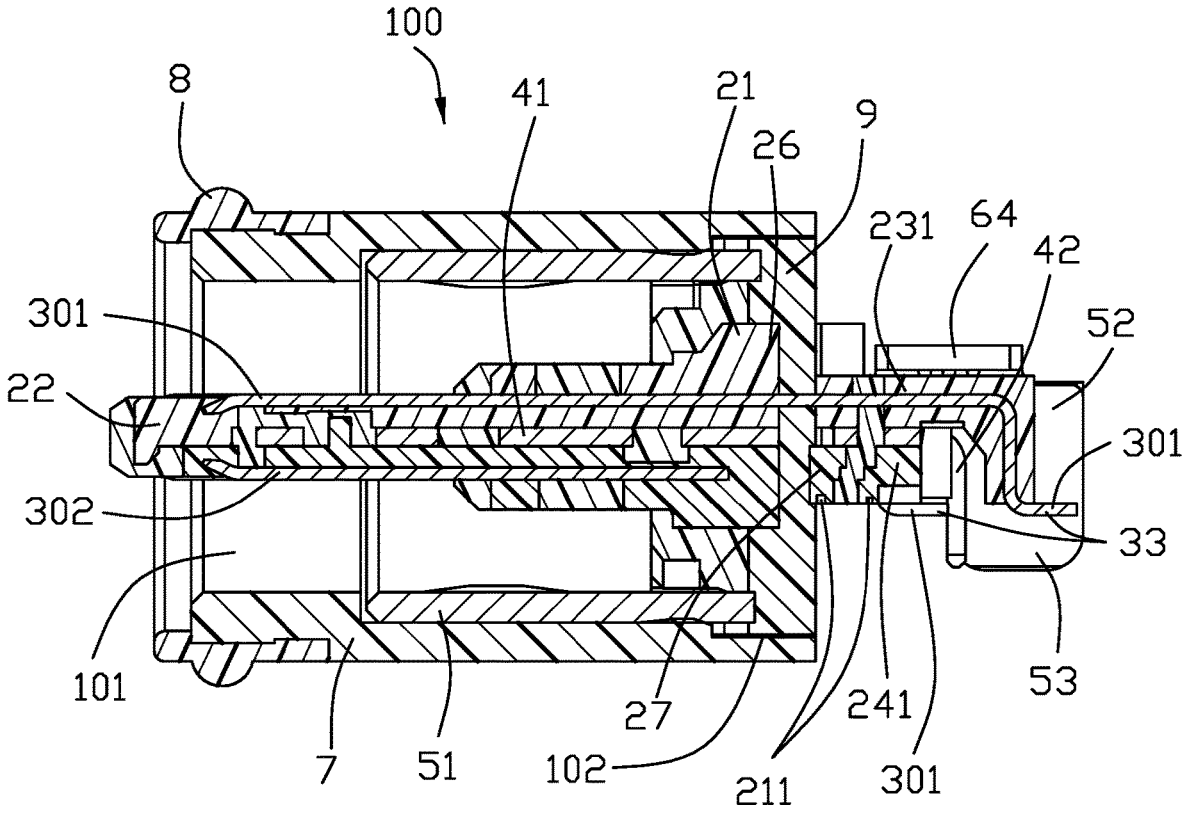
FIG. 20 is a cross-sectional view of the electrical connector of FIG. 12.

Referring to FIGS. 12-20, the connector 100 includes the contact module 10, a shell sub-assembly enclosing the contact module 10, and a metallic bracket 6 retained to the insulative housing, and a waterproofing plate 9. The contact module 10 includes an insulator 2, two rows of contacts 3 and a metallic shielding plate 4 between two rows of contacts 3. The insulator 2 includes a base 21, a tongue 22 extending forwardly from the base 11. The base 21 includes a front part 26 and a rear part, i.e., the mounting port 27 in the front-to-back direction. A pair of upwardly protrusions 211 are formed on the rear part 27. A pair of grooves 222 are formed on two opposite side edges of the tongue 22. A pair of protrusions 221 are formed on a front end of the tongue 22 The insulator 2 includes an upper insulator 23 and a lower insulator 24, and further a final insulator 25 over-molded upon both the upper insulator 23 and the lower insulator 24. The upper insulator 23 includes a first base 231, and a first tongue 232 forwardly extending from the first base 231. The lower insulator 24 includes a second 241 and a second tongue 242 forwardly extending from the second base 241. The final insulator 25 includes a third base 241 and the third tongue 252 forwardly extending from the third base 251. Understandably, the first base, 231, the second base 241 and the third base 251 commonly form the base 21, and the first tongue 232, the second tongue 242 and the third tongue 252 commonly form the tongue 22.

The two rows of contacts 3 include the upper contacts 301 and the lower contacts 302. The contact 3 includes the retaining section 32, the contacting section 31 exposed upon the tongue 22, and the soldering leg 33 exposed outside of the rear part 27. Understandably, the upper contacts 301 are integrally formed within the upper insulator 23, and the lower contacts 302 are integrally formed within the lower insulator 24. The shielding plate 4 is sandwiched between the upper insulator 23 and the lower insulator 24 to integrally formed within the final insulator 25.

Two escaping groove 212 are formed in an upper surface of the rear part 27 adjacent to the soldering legs of the upper contacts 301 and those of the lower contacts 302, respectively. The shielding plate 4 includes a main body 41 and a pair of securing legs 42. The shell sub-assembly including a metallic shell 5 and an insulative housing 7, encloses the contact module 10. The metallic bracket 6 is embedded within the insulative housing 7. The waterproof ring 8 is applied upon a front region of the insulative housing 7. A space 102 is formed between the insulative housing 7 and the base 21, and the waterproof plate 9 is received therein. Actually, similar to the first embodiment, the circumferential groove (not labeled) is formed between the front part 26 and the rear part 27 of the base 21 to expose the retaining sections of the corresponding contacts 3, and is aligned with the space 102 in the vertical direction so as to receive the corresponding waterproof plate 9 too. The metallic shell 5 includes a main part 51, a pair of side arms 52 and a pair of legs 53 extending from the side arms 52. The metallic bracket 6 includes two parts each having an embedded section 61, a fixing section 62 laterally exposed outside of the base, and a fixing arm 63 with the engaging part 64 engaged with the protrusion 211, and an abutment part 65. The fixing arm 63 abuts against the corresponding side arm 52 and preferably welded thereon.

The waterproof plate is originally in a liquid type filling the space 102. Notably, because of the escaping groove 212 which extends in a transverse direction and is located between the space 102 and the soldering legs 33 in the front-to-back direction, the liquid type glue of the glue plate may not contaminate the soldering legs 33.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

a contact module including a plurality of contacts integrally formed within an insulator, the insulator including a base, a tongue portion extending forwardly from the base in a front-to-back direction, and a mounting port extending rearwardly from the base, each of said contacts including a retaining section retained in the base, a contacting section forwardly extend from the retaining section and exposed upon the tongue portion, and a soldering leg extending rearward from the retaining section and exposed outside of the mounting port;

the insulator further including a groove between the base and the mounting port in the front-to-back direction and extending therethrough in a vertical direction perpendicular to the front-to-back direction to exposed portions of retaining sections of the contacts; and an insulative housing made of liquid silicon rubber and filling the groove to seal gaps between the contacts and the insulator; wherein said insulative housing further forms a circumferential exterior of the connector without any metallic shell thereon for installation into an enclosure of a mobile phone in a snug manner.

2. The electrical connector as claimed in claim 1, wherein the base includes a pair of semi-circular sections on two sides and sandwiched in the insulative housing in the front-to-back direction.

3. The electrical connector as claimed in claim 2, wherein a cutout is formed between said pair of semi-circular sections and filled with the insulative housing.

4. The electrical connector as claimed in claim 2, wherein an exterior surface of the semi-circular section is coplanar with that of the insulative housing.

5. The electrical connector as claimed in claim 1, wherein the contact module further includes a metallic shielding plate with a receiving opening aligned with the groove in the vertical direction and filled with the insulative housing.

6. The electrical connector as claimed in claim 5, wherein the shielding plate further includes a pair of securing section exposed on two opposite sides of the insulator, each securing section forming a through hole in the vertical direction.

7. An electrical connector comprising:

a contact module including a plurality of contacts integrally formed within an insulator, the insulator including a base, a tongue portion extending forwardly from the base in a front-to-back direction, and a mounting port extending rearwardly from the base, each of said contacts including a retaining section retained in the base, a contacting section forwardly extend from the retaining section and exposed upon the tongue portion, and a soldering leg extending rearward from the retaining section and exposed outside of the mounting port;

the insulator further including a groove between the base and the mounting port in the front-to-back direction and extending therethrough in a vertical direction perpendicular to the front-to-back direction to exposed portions of retaining sections of the contacts; and waterproofing plate solidified from a liquid waterproof material and filling the groove to seal gaps between the contacts and the insulator; wherein an escape groove is formed in an undersurface of the mounting port adjacent to the soldering legs for preventing contamination thereof.

8. The electrical connector as claimed in claim 7, further including a shell sub-assembly enclosing the insulator, wherein said shell sub-assembly includes an insulative housing enclosing a metallic tubular shell, and a receiving space is formed in the insulative housing and aligned with the groove in the vertical direction so as to receive the waterproof plate therein.

9. The electrical connector as claimed in claim 8, further including a pair of metallic brackets integrally formed within the insulative housing, wherein each of said bracket includes a fixing section exposed laterally outside of the insulator.

10. The electrical connector as claimed in claim 9, wherein each bracket further includes a fixing arm abutting against a corresponding side arm of the metallic tubular shell in a transverse direction perpendicular to both the front-to-back direction and the vertical direction.

11. The electrical connector as claimed in claim 10, wherein the fixing arm engages the base.

12. An electrical connector comprising:

a contact module including a plurality of contacts integrally formed within an insulator, the insulator including a base, a tongue portion extending forwardly from the base in a front-to-back direction, and a mounting port extending rearwardly from the base, each of said contacts including a retaining section retained in the base, a contacting section forwardly extend from the retaining section and exposed upon the tongue portion, and a soldering leg extending rearward from the retaining section and exposed outside of the mounting port;

the insulator further including a groove between the base and the mounting port in the front-to-back direction and extending therethrough in a vertical direction perpendicular to the front-to-back direction to exposed portions of retaining sections of the contacts; and an insulative housing made from liquid type waterproof material and filling the groove to seal gaps between the contacts and the insulator; wherein the contact module further includes a metallic shielding plate with a receiving opening aligned with the groove in the vertical direction and filled with the insulative housing; wherein the shielding plate further includes a pair of securing section exposed on two opposite sides of the insulator, each securing section forming a through hole in the vertical direction.

13. The electrical connector as claimed in claim 12, wherein the insulative housing circumferentially encloses the insulator.

14. The electrical connector as claimed in claim 13, wherein the tongue portion is fully exposed in front of both the base and the insulative housing.

* * * * *